United States Patent [19]

Huijbers et al.

[11] Patent Number: 4,864,181

[45] Date of Patent: Sep. 5, 1989

[54] ELECTRIC INCANDESCENT LAMP HAVING TRUNCATED CONICAL FILAMENT AND A MIRROR COATING

[75] Inventors: Antonius J. Huijbers; Johannes W. Ingeveld, both of Weert, Netherlands

[73] Assignee: U.S. Philips Corporation, New York, N.Y.

[21] Appl. No.: 236,267

[22] Filed: Aug. 23, 1988

Related U.S. Application Data

[63] Continuation of Ser. No. 921,025, Oct. 20, 1986, abandoned.

[30] Foreign Application Priority Data

Oct. 29, 1985 [NL] Netherlands ..... 8502942

[51] Int. Cl.[4] ..... H01K 1/02; H01K 1/26

[52] U.S. Cl. ..... 313/113; 313/115; 313/315

[58] Field of Search ..... 313/113, 315, 316, 578, 313/580, 115

[56] References Cited

U.S. PATENT DOCUMENTS

| | | | |
|---|---|---|---|
| 1,578,920 | 3/1926 | Robinson | 313/115 |
| 4,103,201 | 7/1978 | Wosby | 313/315 X |
| 4,317,060 | 2/1982 | Fitzgerald et al. | 313/113 |

FOREIGN PATENT DOCUMENTS 210990 6/1983 United Kingdom .

*Primary Examiner*—David K. Moore
*Assistant Examiner*—Sandra L. O'Shea
*Attorney, Agent, or Firm*—Brian J. Wieghaus

[57] ABSTRACT

The electric incandescent lamp according to the invention has an annular mirror coating on a hemispherical portion of its lamp envelope and a filament arranged zigzagwise between supporting points which are located on the surface of an imaginary cone. The filament is situated outside the part of the lamp vessel provided with the mirror coating. The lamp is particularly suitable for use as a traffic signal lamp and produces together with an external paraboloidal reflector a light beam of high luminous intensity at the center and in directions enclosing a small angle with the axis of the beam, as a result of which the lamp may be designed for a comparatively low power.

8 Claims, 3 Drawing Sheets

FIG. 4
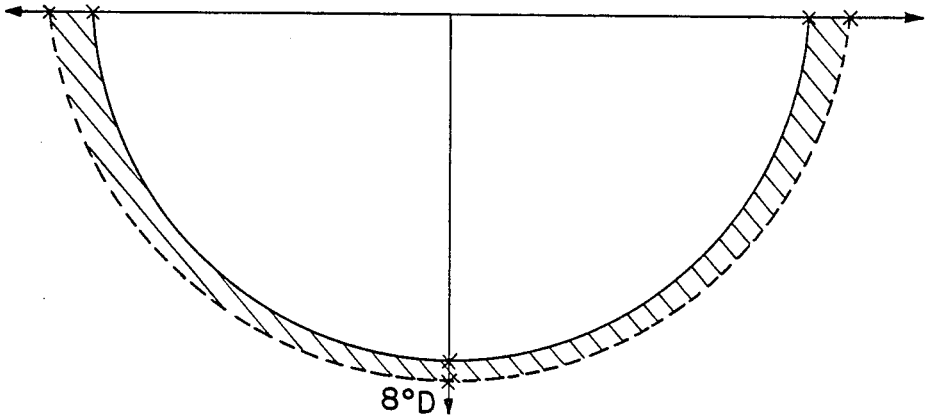
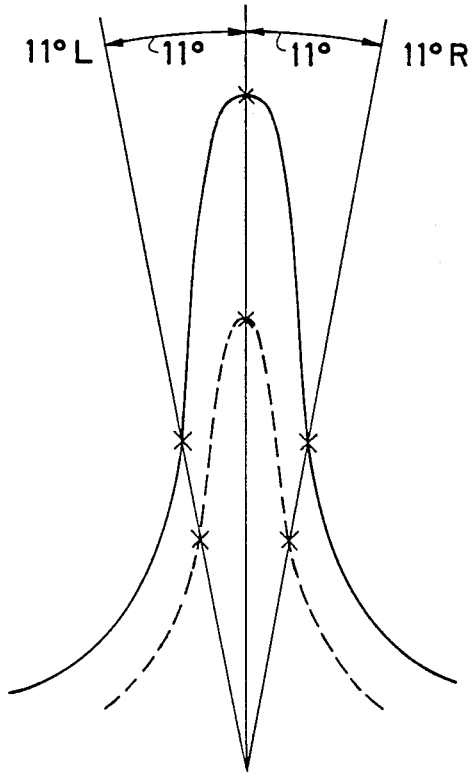
FIG. 5

ELECTRIC INCANDESCENT LAMP HAVING TRUNCATED CONICAL FILAMENT AND A MIRROR COATING

This is a continuation application Ser. No. 921,025, filed Oct. 20, 1986, now abandoned.

BACKGROUND OF THE INVENTION

The invention relates to an electric incandescent lamp provided with a glass lamp vessel or envelope, which is sealed in a vacuum-tight manner, a lamp cap provided with contacts is secured to the lamp vessel in which a filament is arranged, which is electrically connected to contacts of the lamp cap.

The lamp vessel having opposite to the lamp cap a substantially hemispherical part, which has an axis of symmetry and has a reflective coating except in a window region near and around this axis.

The filament is arranged between a plurality of supporting points, around the axis of symmetry near the widest boundary of the reflective coating.

Such a lamp is known from GB 2,109,990 (Thorn EMI plc, 8 June 1983).

The known lamp has a filament, which is arranged in a flat plane which is at right angles to the axis of symmetry. The filament is situated within the hemispherical part of the lamp vessel.

The lamp of the kind mentioned in the opening paragraph is intended to be used in, for example, an external paraboloidal reflector. Light thrown by the filament onto the reflective coating of the lamp vessel is reflected to the external reflector and is concentrated by the latter to a light beam together with light thrown directly onto the external reflector by the filament.

In the hemispherical wall portion of the lamp vessel, the known lamp has a region not provided with a mirror-coating, which has for its object to keep the temperature of the lamp cap as low as possible. If this region should also be provided with a mirror coating, thermal and luminous radiation thrown onto this coating would in fact be reflected to the lamp cap.

The known lamp is suitable to be used at areas at which by a high luminous intensity the attention should be drawn to an object. However, the known lamp has proved to be not particularly suitable for applications in which stringent requirements are imposed on the shape of the light beam formed by the lamp together with an external reflector. Traffic signals form such an application. It has in fact been found that in the known lamp the position occupied by the filament with respect to the reflector is particularly critical. A forward or backward displacement of the filament of a few tenths of a millimeter with respect to the focus of the external reflector is already inadmissible in this lamp when used as a traffic signal lamp, unless the lamp consumes a higher power than is necessary in case of a correct positioning of the filament.

The particularly small tolerance in the position of the filament with respect to the external reflector requires, when used as a traffic signal lamp, an extremely accurate mounting of the filament in the lamp vessel. However, it is thus not guaranteed that the desired result is obtained. Fatal deviations from the correct position of the filament with respect to the external reflector may still be obtained due to the fact that the lamp is screwed more or less firmly into the lamp holder. However, also with the use of a Swan lamp cap and Swan lamp holder, such deviations may be obtained in case of a wrong positioning of the lamp holder with respect to the reflector. Moreover, it has been found that the known lamp has a short life.

SUMMARY OF THE INVENTION

The invention has for its object to provide a lamp of the kind mentioned in the opening paragraph, which is particularly suitable to be used as a traffic signal lamp, more particularly a lamp of which the position of the filament is not particularly critical. Furthermore, the invention has for its object to provide a lamp which, when used in an external reflector, produces a light beam having a high center value and a satisfactory beam width, which nevertheless consumes a comparatively low power and which has a comparatively long life.

According to the invention, this object is achieved in that the filament is situated at least substantially outside the part of the lamp vessel provided with a reflective coating and is arranged zigzagwise between supporting points, which are located at least substantially on the surface of an imaginary cone, which is at least substantially coaxial with the hemispherical part of the lamp vessel.

Due to the location of the supporting points and the zigzagwise arrangement of the filament between these supporting points, several effects are obtained. The filament extends over a certain distance along the axis of symmetry. Thus, it is achieved that the position of the filament with respect to the external reflector with which the lamp has to cooperate is not particularly critical. A small displacement of the filament in forward or backward direction substantially does not influence the beam produced. Always parts of the filament will be situated in the focal plane of the external reflector (the plane through the focus at right angles to the axis of the reflector) and other parts will be situated immediately before and behind this plane, respectively.

Another effect of the arrangement of the filament is that the filament has a small extent so that the parts of the filament are close to each other, as a result of which the emitted light can be satisfactorily concentrated to a beam. At the center of the beam produced, a high luminous intensity is thus attained, as a result of which the beam has a large range of action. On the other hand, when the lamp is used as a traffic signal lamp, it has to be achieved that the traffic near the signal and therefore generally laterally off the center line of the beam can observe the signal. The arrangement of the filament, which ensures that parts the filament are situated closer to the axis of symmetry than other parts, is then of great importance. It has proved to be favourable if the imaginary cone is orientated so that its base is situated near the lamp cap and its tip is remote from the lamp cap.

The window in the reflective coating has the favourable consequence that the luminous intensity at the center of the beam produced is higher than in the absence of this window. It has proved to be favourable if the dimensions of the window transverse to the axis of symmetry is at least as large as the largest transverse dimension of the filament. Accordingly as a beam of larger width is required, the window can be chosen to be larger. In order to maintain a high luminous intensity at the center of the beam, the window will generally not be chosen to be wider than 2 times, more particularly 1.75 times, the largest transverse dimension of the filament.

The reflective coating may consist of a vapour-deposited gold, silver or aluminium layer, for example at the inner surface of the filament.

Placing the filament at least substantially outside the part of the lamp vessel provided with the mirror coating, prevents parts of the filament or parts of its support from being strongly heated by radiation reflected by the mirror coating. Thus, the filament is prevented from breaking prematurely, which would result in the end of the life of the lamp. Although in the construction according to the invention the support of the filament is heated by radiation, local excessive heating, which occurs if a filament or a part thereof arranged within the mirror-coated part of the lamp vessel is imaged by the mirror coating on the support or on the filament, is avoided.

An embodiment of a lamp according to the invention is shown in the drawing. In the drawing: dr

BRIEF DESCRIPTION OF THE DRAWING

FIG. 4 is a plot of the luminous intensity along directions I11L, I11R, and 18D for lamps 4 and 5 normalized with respect to Io for each lamp.

FIG. 5 is a plot of the luminous intensity for lamps 4 and 5 along directions I11L, Io, and I11R.

In FIG. 1, the electric incandescent lamp comprises a glass lamp vessel 1, which is sealed in a vacuum-tight manner, to which a lamp cap 2 is secured having contacts 3 and 4, and in which a filament 5 is arranged, which is electrically connected through current supply conductors 6 to the contacts 3, 4 of the lamp cap 2.

Figure 1:
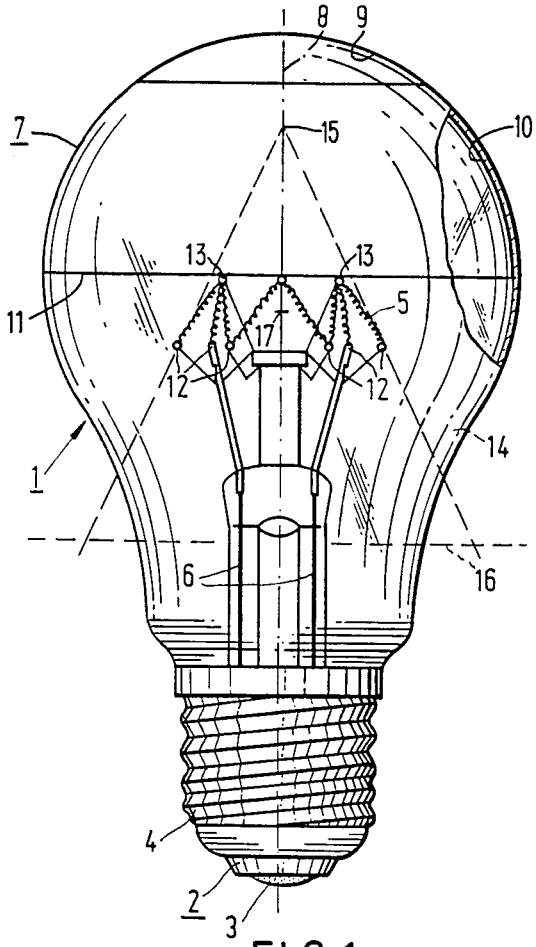
FIG. 1 shows a side view of the lamp.

Opposite to the lamp cap 2, the lamp vessel has a hemispherical part 7, which has an axis of symmetry 8 and which has a mirror coating 10 except in a window region 9 near and around this axis 8. In the lamp shown, the lamp vessel 1 is transparent, except at the area of the mirror coating 10, which in the embodiment shown is an internal vapour-deposited aluminium layer. A transparent lamp vessel is advantageous because the light rays can then emanate without being scattered.

Near the widest boundary 11 of the mirror coating 10, the filament 5 is arranged between a number of supporting points 12, 13 around the axis of symmetry 8.

The Figure shows that the filament 5 is situated at least substantially outside the part of the lamp vessel provided with the mirror coating 10 and is arranged zigzagwise between supporting points 12, 13, which are located at least substantially on the surface of an imaginary cone 14, which is at least substantially coaxial with the hemispherical part 7 of the lamp vessel. The tip 15 of the cone 14 is remote from the lamp cap 2, while the base 16 is near the lamp cap 2.

Figure 2:
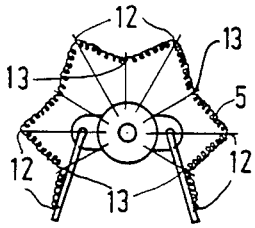
FIG. 2 shows the front view of the filament of the lamp shown in FIG. 1 with its supporting points.
Figure 3:
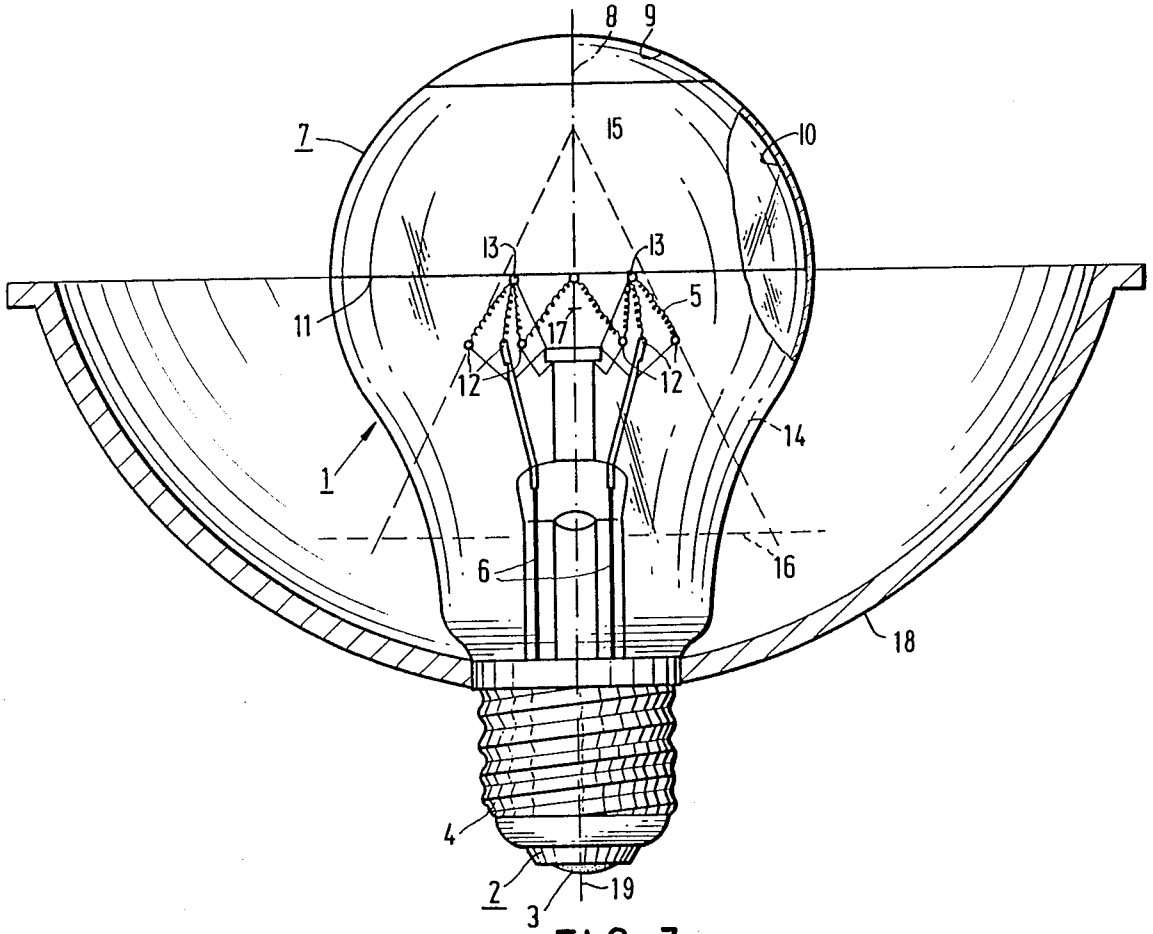
FIG. 3 shows the lamp of FIG. 1 with an external reflector (shown in cross-section).

FIGS. 1 and 2 together illustrate that the filament 5 is arranged zigzagwise between a first series of supporting points 12 forming a wide circle and a second series of supporting points 13 forming a small circle. The filament 5 has a certain height, that is a certain dimension in the direction of the axis 8 (about 11 mm), as a result of which a large tolerance is obtained for the position of the filament 5 with respect to the focus of an external reflector FIG. 3 shows reflector 18 having its axis 19 coincide with the lamp axis 8. The focus of the reflector, must be located according to the design of the lamp at the point 17. Also with a non-ideal positioning of the filament 5 with respect to the said focus, parts of the filament 5 are situated in and on either side of the plane through the said focus and at right angles to the axis 8. As a result, a non-idal positioning does not or substantially does not influence the light beam.

In the embodiment shown, the largest transverse dimension of the filament is about 24 mm, while the diameter of the region 9 not provided with a mirror-coating is about 38 mm.

It has been found that also under practical conditions in which it is frequently switched on and off and is subjected to vibrations, the lamp shown has a long life. The lamp produces together with an outer reflector an excellent light beam, as a result of which the lamp need consume a comparatively low power.

The lamp according to the invention has operated in a traffic light with a red lens and was tested with respect to the Netherlands Standard NEN 3322. The lamp was compared on the one hand with lamps having a filament of the same shape, but having a lamp vessel not provided with a mirror coating, and on the other hand with a lamp having an annular mirror on the lamp vessel, as in the lamp according to the invention, but having a flat filament stretched in a plane at right angles to the axis of the lamp.

The results are indicated in Table 1.

TABLE 1

| | | | | | Io | I11L | I11R | I8D(cd) |
|---|---|---|---|---|---|---|---|---|
| | | | | | Standard NEN 3322 | | | |
| lamp | | | M | F | 300 | 150 | 150 | 150 |
| 1. | 75 W | 225 V | − | con | 281 | 178 | 158 | 160 |
| 2. | 100 W | 225 V | − | con | 395 | 244 | 235 | 207 |
| 3. | 75 W | 225 V | + | con | 418 | 250 | 238 | 186 |
| 4. | 70 W | 100 V | + | fl | 291 | 158 | 147 | 135 |
| 5. | 70 W | 100 V | + | con | 435 | 215 | 196 | 192 |

Io = luminous intensity in a direction enclosing 0° with the axis of the lamp
I11L = luminous intensity in a direction enclosing 11° with the axis to the left
I11R = luminous intensity in a direction enclosing 11° with the axis to the right
I8D = luminous intensity in a direction enclosing 8° with the axis downwards
M = mirror present?
+ = yes;
− = no
F = shape filament:
con = conical;
fl = flat.

It appears from this table that the clear lamp 1 of 75 W does not satisfy the standard. The lamp 2 of 100 W amply satisfies this standard, but the standard is also amply attained by the lamp of 75 W (lamp 3) according to the invention.

It further appears that with a mirror-coated lamp (4) having a flat filament and consuming 70 W the standard is not reached. However, if the same filament is arranged in accordance with the invention (lamp 5), this standard is largely exceeded.

FIG. 4 illustrates the luminous intensity along directions 11L (11 degrees left), 11R (11 degrees right), and 8D (8 degrees down) for lamps 4 and 5 as a percentage of the luminous intensity Io along 0 degrees for each lamp. For each lamp the values for the luminous intensities I11L, I11R and I8D are normalized with respect to the Io value for that lamp. The shaded portion represents the difference between the flat filament and the conical filament. Along the directions 11L, 11R, and 8D LAMP 4 having conical filament and has a narrower beam relative to its Io value than does LAMP 5 with the flat filament when used with the same external reflector and lens.

FIG. 5 illustrates the luminous intensity of the flat filament of lamp 4 with respect to the conical filament of lamp 5 along the directions 0, 11L, 11R. The conical filament has a greater luminosity in these directions than a flat filament of the same voltage and wattage rating used with the same lens and reflector.

Since traffic signal lamps mostly operate a large number of hours each day, substantial savings in energy consumption can be attained with the lamp according to the invention.

It should be noted that the values of the luminous intensity of lamp 3 cannot immediately be compared with those of lamp 5 because of greatly different dimensions of the filament due to the different operating voltages.

What is claimed is:

1. In an incandescent electric lamp comprising an axially symmetrical lamp envelope having a generally spherical end portion and smaller base end, an incandescent lamp filament within said lamp envelope and filament mounting means for mounting said filament within said lamp envelope, the improvement comprising:

a reflective layer disposed in an annular band on said spherical end portion of said envelope about the lamp axis of symmetry and having a central translucent opening centered on the spherical end of said lamp;

said filament mounting means defining a first plurality of filament support points disposed in a plane at regular intervals in a locus circularly circumscribing the lamp envelope axis of symmetry and a second plurality of filament support points disposed in a second plane at regular intervals in a locus circularly circumscribing the lamp envelope axis of symmetry and having a diameter greater than the locus of said first plurality of filament support points;

said filament supported on said support points and spanning between support points alternately in said first plurality and said second plurality of support points; and said filament mounting means positioning said filament substantially outside said annular band having said reflective layer.

2. An electric incandescent lamp as claimed in claim 1, wherein said second plurality of support points is closer to the lamp base than said first plurality of support points.

3. In an incandescent electric lamp according to claim 2, said central opening of said reflective layer having a diameter greater than the diameter and less than about twice the diameter of the locus of said second plurality of said filament support points.

4. In an incandescent electric lamp comprising an axially symmetrical lamp envelope having a generally spherical end portion and smaller base end, an incandescent lamp filament within said lamp envelope and filament mounting means for mounting said filament within said lamp envelope, the improvement comprising:

a symmetrical reflective layer disposed in an annular band on said spherical end portion of said envelope symmetrically about the lamp axis of symmetry and having a central clear opening centered on the spherical end of said lamp;

said filament mounting means defining a first plurality of filament support points disposed in a plane at regular intervals in a locus circularly circumscribing the lamp envelope axis of symmetry and a second plurality of filament support points disposed in a second plane closer to the lamp base than said first plurality of filament support points at regular intervals in a locus circularly circumscribing the lamp envelope axis of symmetry and having a diameter greater than the locus of said first pluraity of filament support points;

said filament supported on said support points and spanning between support points alternately in said first plurality and said second plurality of support points; and said filament mounting means positioning the plane of said first plurality of filament support points and the plane of said second plurality of filament support points relative to said reflective layer such that no portion of said filament is imaged by said reflective layer.

5. An electric incandescent lamp, for use with an external reflector having an axis of symmetry and a focal plane, comprising:

(a) a lamp cap;

(b) an outer envelope attached to said lamp cap, said envelope having a rounded portion with a reflective coating for reflecting lamp light to the external reflector, said rounded portion having an axis of symmetry which is at least substantially coaxial with the reflector axis of symmetry;

(c) a filament, energizable for emitting light which is arranged substantially in the surface of an imaginary cone, said surface being bounded by a first transverse plane a first distance from said lamp cap and a second transverse plane a second distance from said lamp cap, the height dimension of said filament being the distance along the cone axis between said transverse filament planes; and (d) means for supporting said filament within said outer envelope so that said filament is at least substantially coaxial with the axis of symmetry of the external reflector and said filament is located substantially outside the portion of the lamp envelope having a reflective coating so that no portion of the filament is imaged by said reflective coating thereby preventing local excessive heating of the filament.

6. A lamp as claimed in claim 5, wherein said filament comprises filament segments, each said segment having a first end and a second end, said supporting means further comprises means for supporting said segment first ends on said first transverse plane and means for supporting said segment second ends on said second transverse plane so that said filament segments are arranged in a zig-zag manner on the surface of said portion of said cone.

7. A lamp as claimed in claim 6, wherein said surface of said imaginary cone diverges in the direction of the lamp cap, said filament having a largest transverse dimension measured transverse to the cone axis and a smallest transverse dimension measured transverse to the cone axis, and said rounded portion has a reflective coating everywhere except in a window region proximate the axis of symmetry of the external reflector, said window region having a transverse dimension at least as large as the largest transverse dimension of said filament for enhancing the luminosity at the center of the light beam from the external reflector and lamp.

8. A lamp as claimed in claim 7, wherein the largest dimension of said window is less than two times the largest transverse dimension of said filament.

* * * * *